US005381617A

United States Patent [19]

Schwartztol et al.

[11] Patent Number: 5,381,617

[45] Date of Patent: Jan. 17, 1995

[54] LUGGAGE TAG AND METHOD

[76] Inventors: Robert Schwartztol, 12700 SW. 27th Ct., Miami, Fla. 33156; SecunDino Ferreiro, 4300 NE. 17th Ter., Oakland Park, Fla. 33334

[21] Appl. No.: 127,768

[22] Filed: Sep. 28, 1993

[51] Int. Cl.[6] ..... G09F 3/14

[52] U.S. Cl. ..... 40/6; 40/665; 40/299

[58] Field of Search ..... 40/6, 633, 665, 299, 40/304, 302; 283/86, 81

[56] References Cited

U.S. PATENT DOCUMENTS

| | | | |
|---|---|---|---|
| 627,920 | 6/1899 | Gould | 40/665 |
| 1,084,407 | 1/1914 | Deist | 40/665 X |
| 2,768,458 | 10/1956 | Anania | 40/665 |
| 2,811,797 | 11/1957 | Teetor | D20/22 |
| 4,837,959 | 6/1989 | Celico | 40/299 X |
| 4,914,843 | 4/1990 | DeWoskin | 40/665 X |

*Primary Examiner*—James R. Brittain
*Assistant Examiner*—Cassandra Davis
*Attorney, Agent, or Firm*—Jack E. Dominik

[57] ABSTRACT

Disclosed is a luggage tag cutout of a blank board, usually in groups, in which each tag has a display plate, the reverse side of which is an identification plate (ID plate) and a strap extends longitudinally from the plate which can be looped around the handle or other extension of the luggage and then pass through a slot in the plates and secured to a locking assembly at the strap end of the plates after being passed through the plate and then adhesively secured to the locking assembly and ultimately secured in place by means of locking ears which are adhesively coated on one side to fold over the lower portion of the strap and secure the luggage plate to the appropriate piece of luggage is disclosed.

5 Claims, 2 Drawing Sheets

LUGGAGE TAG AND METHOD

FIELD OF THE INVENTION

The present invention relates to tags, and more specifically the type that are applied to luggage. A specific application is involved when tagging luggage for cruise ships where there may be at least a thousand passengers and at least two thousand pieces of luggage, all of which must be loaded and unloaded expeditiously as well as directed accurately to and from the owners of the luggage to and from their respective cabins, embarking areas and debarking areas.

SUMMARY OF THE PRIOR ART

Luggage tags have been known for years. Most of them have a strap of some sort which encircles the handle or other extension of the luggage in a relatively irremovable manner. Some are made with a leather strap and a metal tag; others are just paper wrap-arounds, and others are plastic tags secured by means of nylon cord, string, and the like. The string type tags cannot be "snuggled up" to the handle of the luggage that readily. This is particularly true where the unskilled or the older person is concerned who is applying the tag to the luggage. Moreover, the strings can be readily pulled off of the tag.

Tags create the further disadvantages in that they are oftentimes supplied a thousand in a box, and in a disorderly disarray in the box. Indeed, manual separation of the tags are required to render them available for being inserted in the envelope which is sent to the passenger along with his ticket and usually where a couple are involved, there are six luggage tags and two tickets.

When a cruise ship is being loaded with the luggage for several passengers, whether it be one hundred, one thousand, or two thousand, identifying the luggage and moving it on and off the ship to the appropriate cabins can be a nightmare if not properly organized. Moreover, many pieces of luggage are mass-produced and lose their identity where several hundred pieces of luggage can be substantially identical in appearance and yet have several hundred different owners.

To solve the potential problem, it is highly desirable that the luggage tags applied to luggage prior to be loaded aboard ship be uniform in appearance, easy to apply, and susceptible of coding or other indicia which makes moving the luggage and directing it highly accurate.

SUMMARY OF THE INVENTION

The present invention derives from forming a luggage tag out of a blank board, usually in groups. Each tag has a display plate, the reverse side of which is an identification plate (ID plate) and a strap which extends longitudinally from the plate. The strap can be looped around the handle or other extension of the luggage and then passed through a slot in the plates and secured to a locking assembly at the strap end of the plates. The strap is then adhesively secured to the locking assembly and ultimately secured in place by means of locking ears which are adhesively coated on one side to fold over the lower portion of the strap and secure the luggage tag to the appropriate piece of luggage. The method of the invention relates to the steps of removing the thus-formed tag from a blank, thereafter opening a strap slot on the display plate, passing the strap through a loop or other engaging portion on a piece of luggage, reversely folding the strap and passing it through the strap slot, and thereafter adhesively securing the strap to the locking assembly and securing in place by folding the tabs. Another aspect of the method looks to the provision of multiple tag blanks in a nested blank board thereby reducing the waste between straps, and increasing the number of tag blanks in a given space for storage prior to use.

A distinct advantage of the present invention is the elimination of the problem with string type tags in which they are oftentimes shipped a thousand in a box. They are in a disorderly array, the strings become entangled each with the other, and they require manual separation. With the present type tag as to be described hereinafter, it can be delivered than folded, it can be delivered in rolls. Indeed, it can be delivered in a roll which is fed to a computer, and the computer can print out the passenger's name, address, cabin identification and other indicia to insist in routing the luggage efficiently.

A further object of the present invention relates to a tag having a printed blank which can serve for identification as to the particular ship, and when color coded, even the deck on the ship where the luggage is to be placed. Further coding can include the sequence of loading and unloading when the passengers from a given deck unload at different time intervals, the time intervals can also be on the identifying plate.

Yet another advantage of the present invention is the provision for an ID plate on the opposite side of the cruise coded plate in which the passenger's identification, address, telephone number, and cabin number can be placed on each tag.

A further object of the present invention is to provide such tags with adhesive securement which are not readily dislodged or torn loose such as string fasteners which can easily rip through the tag and the tag becomes separated from the luggage.

Yet another advantage of the present invention is to provide a luggage tag which can be easily secured snugly to the handle with a tight wrap by merely pulling the mounting strap a bit longer.

Yet another object of the present invention is to provide an attractive uniform type of tag which is relatively inexpensive to manufacture, inexpensive to store, and most importantly susceptible of storage in a minimum of space for a maximum number of the proposed tags.

All of the foregoing advantages are achieved in a tag which, when printed on paper board or of a material equivalent to that of string tags or other type tags, affords efficiencies of handling, identification, and manufacture which render the product significantly superior in durable usage, and supplied with an overall cost effectiveness not achieved by the prior art.

BRIEF DESCRIPTION OF THE DRAWINGS

Further objects and advantages of the present invention will become apparent taken in conjunction with the accompanying illustrative drawings, in which.

DESCRIPTION OF PREFERRED EMBODIMENT

Figure 1:
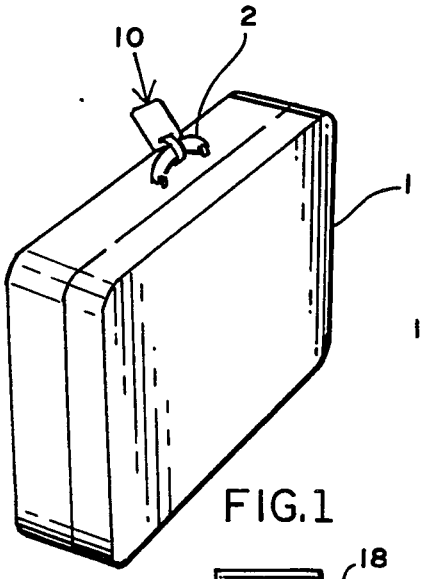
FIG. 1 is a perspective view of a typical piece of luggage having a handle, and a tag exemplary of the present invention applied to the handle.

The illustrative luggage tag 10 will be best understood by first noting its intended environment. In FIG. 1 a typical suitcase 1 is shown having a handle 2 to which the illustrative luggage tag 10 has been applied. Some other types of luggage have straps, or other extensions to which the illustrative luggage tag 10 can be applied.

Figure 5:
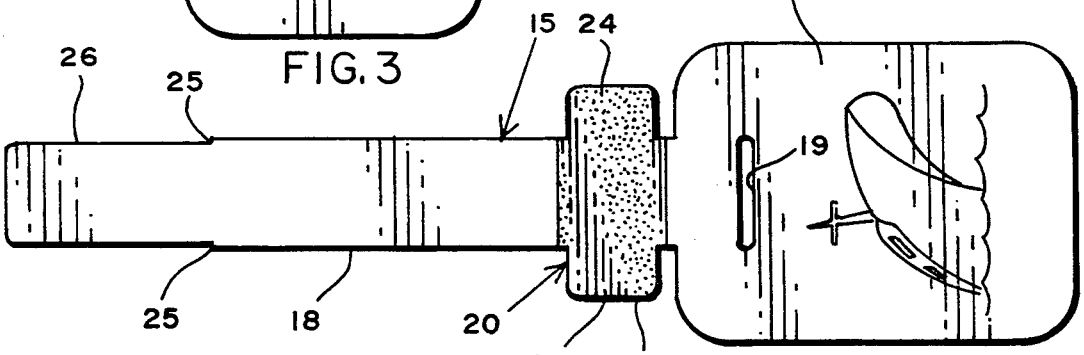
FIG. 5 is a single tag blank ready to have the adhesive shield removed and to insert itself through the luggage handle for securement.

Turning now to FIG. 5, it will be seen that the blank 15 intended for forming the illustrative luggage tag 10 has a display plate 16 at one end, a locking assembly 20 at an intermediate portion, and a strap 18 extending from the locking assembly 20 towards a strap tab end 26. Provision is made for a strap slot 19 which is scored so that it can be readily popped out of the display plate 16. An adhesive shield 21 is applied over the locking assembly 20 and covers the lock body 22 with an adhesive coat 23 over the entirety of the locking assembly 20 which includes the folding tabs 24. Strap stops 25 are provided towards the remote end of the strap 18 which strap terminates in the strap tab end 26.

Figure 2:
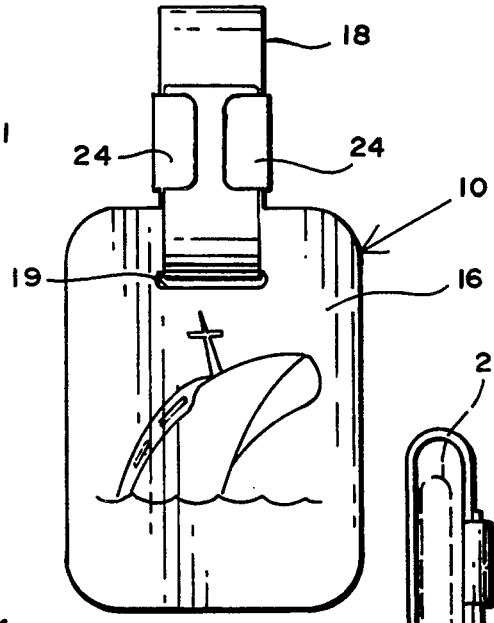
FIG. 2 is a front elevation of the luggage tag shown in FIG. 1 illustrating how the strap is reversely folded, and the display plate readily in view; the handle of the luggage is shown in phantom lines.

Turning now to FIG. 2, where an assembled luggage tag 10 is shown, it will be seen that the strap 18 has been passed through the strap slot 19 and the folding tabs 24 adhesively secured to the adhesive coat 23 at the remote end tab 26 of the strap 18. The adhesive is on the underneath portion of the ears 24 as shown. The luggage handle 2 is shown in phantom lines.

Figure 3:
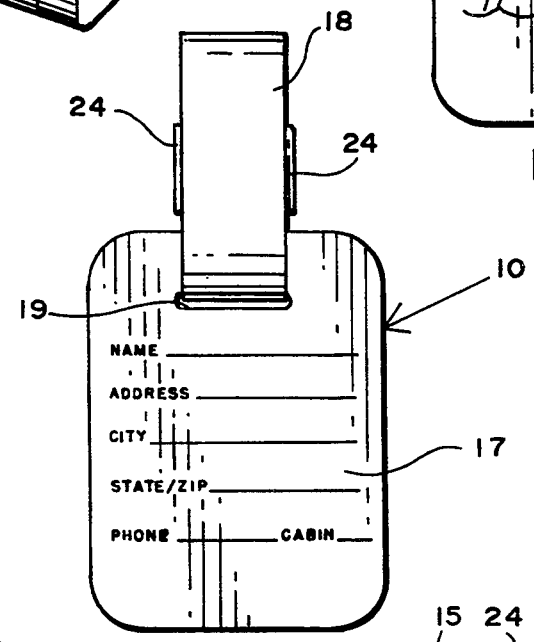
FIG. 3 is a view of the reverse side of the luggage tag shown in FIG. 2 with the identification plate shown.

FIG. 3 shows the reverse portion of an assembled luggage tag 10 where the strap 18 has again been passed through the strap slot 19, and the folding tabs 24 adhesively secured to the rear portion of the strap 18 at the strap tab end 26 (not shown). It is clear from FIG. 3 that the identification plate bears different indicia than the display plate portion 16 shown in FIG. 2.

Figure 4:
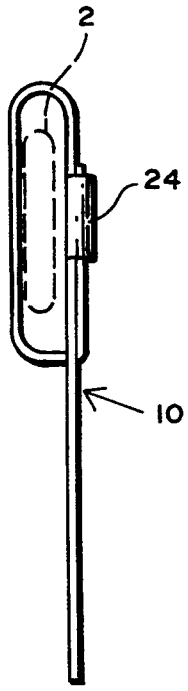
FIG. 4 is an end view of the illustrative luggage tag.

As set forth in the Summary of the Invention, while the display plate 16 here is shown as an imaginary cruiser, numbered indicia identifying the deck, and varying colors identifying the different decks, or numbers indicating time intervals may be applied to the display plate 16. In addition, the reverse side is the identification plate 17 as shown in FIG. 3 where the name, address, telephone number, and cabin of the passenger is filled in by the passenger or the steward who is handling the luggage. Finally, FIG. 4 shows the side view of the finished luggage tag surrounding the handle 2 of the luggage suitcase 1.

Figure 6:
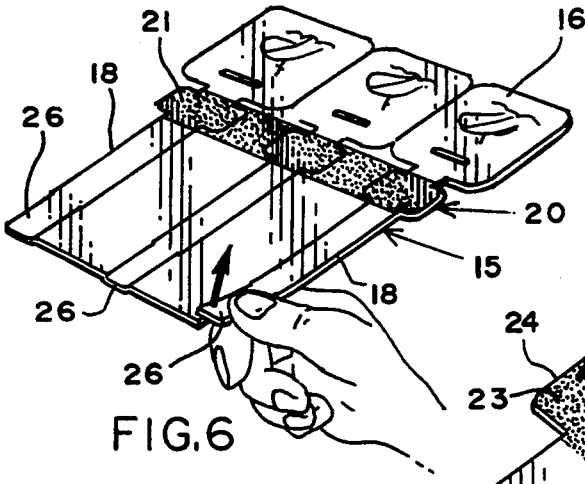
FIG. 6 is a beginning view illustrating the method and the use of the tag showing the hand of the user removing a single blank from a blank board by grasping the end of the strap.
Figure 7:
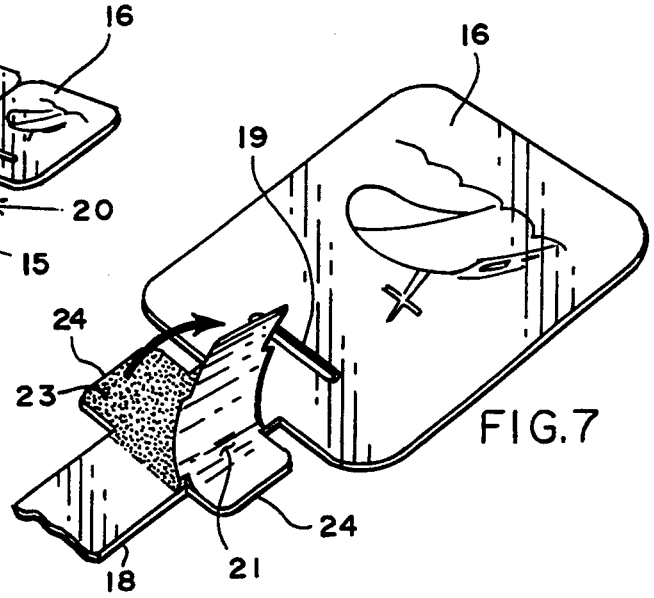
FIG. 7 is a sequential view from FIG. 6 showing how the adhesive shield is removed.
Figure 8:
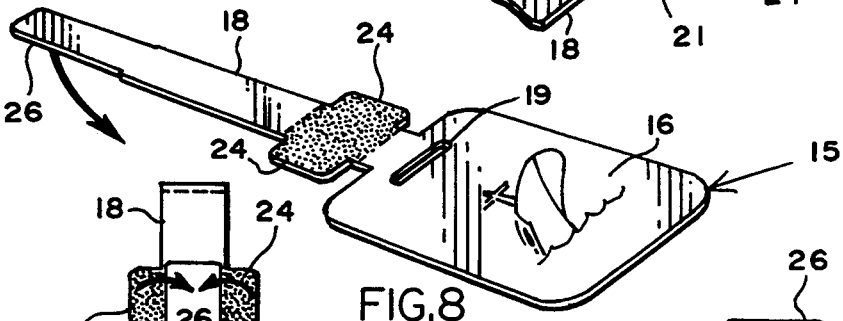
FIG. 8 is yet a further sequential view of the blank with the adhesive shield removed and ready to reversely fold the strap to insert the strap end in the strap slot.
Figure 10:
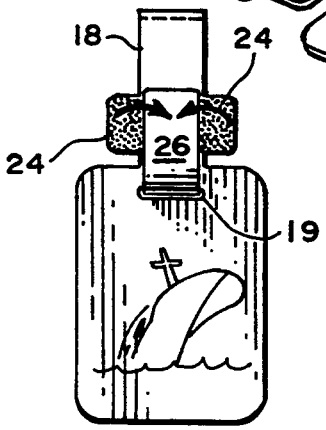
FIG. 10 is yet a further view illustrating how the folding tabs are passed over the strap tab end.
Figure 9:
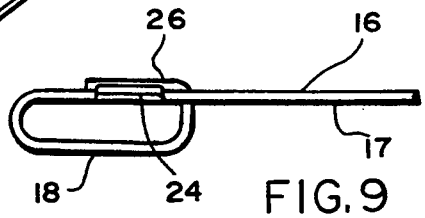
FIG. 9 is yet a further sequential view following FIG. 8 and in end view showing how the strap is passed through the strap slot and moved toward the locking assembly for securement.
Figure 11:
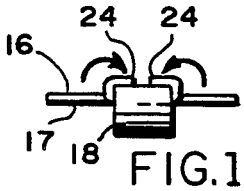
FIG. 11 is an end view in the opposite direction of FIG. 9 showing the folding tabs positioned in plate and securing the luggage tag to the luggage.

Turning now to FIG. 6, it will be seen that the method of applying the tags begins with the blank board 30 which has four luggage tag blanks 15. They are removed sequentially by the fingers grasping the strap tab end 26 and removing the individual luggage tag blank 15 from the blank board 30. Thereafter, as shown diagrammatically in FIG. 7, the adhesive shield 21 is removed from the locking assembly 20 exposing the adhesive coat 23. The tap end 26 is then rotated in the direction of the arrow as shown on FIG. 8 and passed through the slot 19 to go into the position as shown in FIG. 10. Thereafter, the adhesive under side of the tabs 24 are rotated over the strap tab end 26 as shown diagrammatically in FIGS. 9, 10 and 11.

While dimensions do not necessarily form a critical part of the present invention, they are helpful in illustrating proportions. For example, the typical panel shown in FIG. 12 has a width of seven and three quarter inches from the bottom of a panel to the end of the tab, and a length across the four panels of eight and one half inches. Each panel is approximately two and one eighth inches wide, and two and seven eighths inches high. The straps are approximately four and seven eighths inches long, the distance from the end of the tab to the lock stop being one and one half inch. Each tab is approximately three quarters of an inch wide, and the distance from ear end to ear end across the locking assembly is one and one half inches, by approximately five eighths inch thick. The locking slot is centered at a position of approximately two and three eighths inches from the bottom of the display and is approximately three quarters of an inch to thirteen sixteenths inches wide and the slot itself is a one-eighth inch slot.

Figure 12:
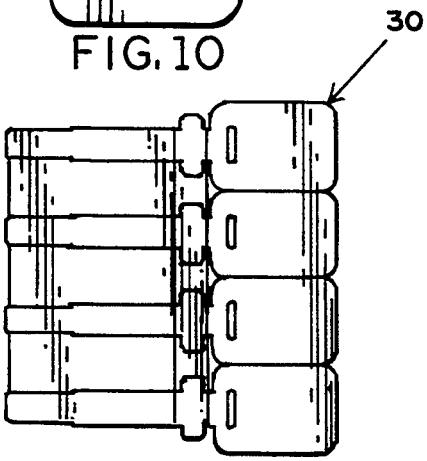
FIG. 12 shows a blank board illustrating four blanks for luggage tags.
Figure 13:
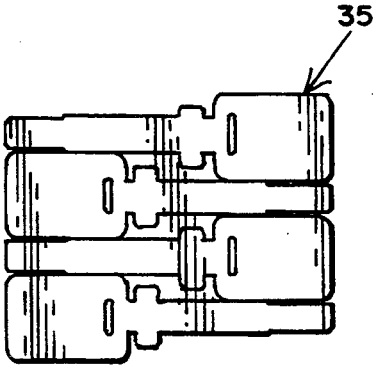
FIG. 13 is an optional nested blank board configuration in which alternating opposed straps are formed adjacent each other to thereby reduce waste on the removal of the blanks and reduce the volume occupied by the luggage tags while in storage.

When four tags are nested in a panel 30 such as shown in FIG. 12, the width of that panel 30 is approximately seven and three quarter inches wide. The length is eight and one half inches. Thus the total square inches utilizing the four tag panel is approximately 65.9 square inches which, divided by four, equals 16.5 square inches per tag. With the nested panel 35 of FIG. 13 which measures nine and one quarter inches times 11 and one half inches, the total number of square inches is approximately 106.4, which when divided by eight yields 13.3 square inches per tag. Thus the nested panel achieves a board saving of about 20%.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. A luggage tag comprising, in combination, a plate portion formed from a blank of material having two sides, a strap receiving means at one end of the plate portion, a strap extending from the plate to a remote end a distance of at least the length of the plate, said strap having a locking assembly adjacent the plate portion to which adhesive has been applied, and including a pair of opposed folding tabs to which adhesive is applied which may be reversely folded, and a tab end portion on the remote end of the strap for reversely looping the strap passing through the strap receiving means and thereafter being secured to the adhesive on the locking assembly between the opposed folding tabs and the folding tabs reversely folded to secure the tab end portion thereby defining a loop of the strap which encircles a member to which the tag is to be secured.

2. In the luggage tag of claim 1, strap stops formed by opposed relieved areas between the strap and the strap remote end to assist in spacing the strap remote end on the adhesive applied portion of the locking assembly when the tag is secured to another member.

3. In the luggage tag of claim 1, a removably secured adhesive shield supplied atop the adhesive applied portion of the locking assembly.

4. The method of securing a luggage tag to a member of luggage, which luggage tag includes a plate, a strap, and a locking means intermediate the strap and the plate, and in which the plate has a slot for receiving the strap, and the locking means has a shield over an adhesive portion, which adhesive portion includes a body and a pair of opposed tabs, comprising the steps of:

removing the shield;

passing the strap around a member on the luggage and then through the plate slot on the plate and reversely folding the strap upwardly to where the strap tab overlies the adhesive portion of the locking means, securing said end to the adhesive portion of the locking means, and reversely folding the tabs over the strap to thereby secure the entire luggage tag to a member on the luggage.

5. In the method of claim 4 above, applying color coded indicia to the plate coordinating with a position in a vessel where the luggage is intended to be.

* * * * *